United States Patent [19]

Kogure et al.

[11] Patent Number: 4,745,431

[45] Date of Patent: May 17, 1988

[54] FIXING DEVICE FOR IMAGE FORMING APPARATUS

[75] Inventors: Mitutosi Kogure, Yokohama; Yuka Nakamura, Kamakura; Makoto Tamura, Tokyo, all of Japan

[73] Assignee: Kabushiki Kaisha Toshiba, Kawasaki, Japan

[21] Appl. No.: 26,299

[22] Filed: Mar. 16, 1987

[30] Foreign Application Priority Data

Mar. 18, 1986 [JP] Japan ..... 61-58324

[51] Int. Cl.[4] ..... G03G 15/20

[52] U.S. Cl. ..... 355/3 FU; 219/216; 219/469; 432/60

[58] Field of Search ..... 355/3 FU, 14 FU; 219/216, 469–471; 432/60, 228

[56] References Cited

U.S. PATENT DOCUMENTS 977,625 12/1910 Hadaway, Jr. ..... 219/469 X 2,870,312 1/1959 Westervelt ..... 219/469

3,471,683 10/1969 Bogue ..... 219/469

4,266,115 5/1981 Dannatt ..... 219/216

4,395,109 7/1983 Nakajima et al. ..... 355/3 FU

*Primary Examiner*—A. C. Prescott

*Assistant Examiner*—J. Pendegrass

*Attorney, Agent, or Firm*—Oblon, Fisher, Spivak, McClelland & Maier

[57] ABSTRACT

A device for fixing a toner image on an image forming medium in an image forming apparatus includes a heating roller and a supporting roller for supporting the sheet of paper and transporting the paper, the heating roller having an inner peripheral surface, and at least one electrically resistive layer on the inner surface of the heating roller for fixing the toner image on the paper and reducing heat loss from the heating roller. Further, the device includes a pair of electrodes at opposite ends of the resistive layer for transmitting electrical power to the resistive layer.

5 Claims, 2 Drawing Sheets

FIXING DEVICE FOR IMAGE FORMING APPARATUS

BACKGROUND OF THE INVENTION

1. Field of the Invention

The present invention relates to an improvement in a fixing device for an image forming apparatus which is used to fix a toner image on an image forming medium such as a sheet of paper passed between a heating roller and a supporting roller.

2. Description of the Prior Art

A heating roller transfers heat to an image forming medium by direct contact in this type of fixing device. Thus, the heat conduction efficiency is better than in other means in which heat is transferred by elements at a distance, such as in a heater lamp system or flash lamp system, etc. Further, in the case of a heating roller, a sufficient amount of heat can be imparted to a toner image formed on the image forming medium in an instant (about 0.020–0.025 sec) even if the temperature in the vicinity of the image forming medium is low. In addition, the amount of power consumed is low, and the device can be made more compact. As a result, this type of device is in wide use as a fixing device in electronic copying machines, electronic printers and similar image forming apparatus.

Conventional fixing devices of this type have a structure in which a heater lamp such as a halogen lamp is provided in a roller body. Thus, since the heat transmission means between the roller body and heater lamp in the heating roller of a conventional fixing device is in the form of light, there is considerable loss of heat due to reflection at the roller body's inner peripheral surface and radiation of light from openings at opposite ends of the roller body.

Consequently, in the case of a high-speed electronic copying machine (40 sheets/minute or more for A4 size paper), for example, the maximum rated power usable by the heater lamp out of the rated power of 1.5 kW for the machine is around 1 kW. Thus, when continuous copying is effected, the heating roller temperature falls, leading to decreased quality of fixing performance.

In the case of a small, low-speed electronic copying machine (15 sheets/minute or less for A4 size paper), as the heating roller has a small heat capacity, its temperature changes at a rapid rate. Since the speed at which the heater lamp light is switched on and off is slower than this rate, the heating roller temperature displays a considerable amplitude of variation. When the heating roller temperature falls, the fixing performance falls. If the heating roller temperature rises too high, there can be problems of softening or deformation of fluororesin, constituting a parting layer on the heating roller's outer surface, and of resin elements, such as heat insulating bearings supporting the roller body and heat insulating gears supplying drive power to the roller body.

OBJECTS OF THE INVENTION

Accordingly, it is an object of the present invention to provide a fixing device for an image forming apparatus in which the drawbacks of the prior art mentioned above have been eliminated.

Specifically, it is an object of the present invention to provide a fixing device for an image forming apparatus which, while having a simple structure, is designed for small heat loss and hence reduction of power, and is provided with a fixing roller in which temperature changes are small and more stable fixing may be effected.

SUMMARY OF THE INVENTION

According to one aspect of the present invention, there is provided a device for fixing a toner image on an image forming medium in an image forming apparatus comprising roller means for supporting the image forming medium and transporting the medium, including a heating roller and a supporting roller, the heating roller including an inner peripheral surface; and heat generating layer means on the inner surface of the heating roller for fixing the toner image on the image forming medium and reducing heat loss from the heating roller.

Preferably, the heating roller includes heat transmissive material, and the heat generating layer means includes at least one electrically resistive layer.

It is also preferred that the heat generating layer means includes a pair of insulating layers on opposite sides of the resistive layer.

It is also preferred that the heat generating layer means includes a pair of electrodes at opposite ends of the resistive layer for transmitting electrical power to the resistive layer.

BRIEF DESCRIPTION OF THE DRAWINGS

These and other objects and advantages of this invention will become more apparent and more readily appreciated from the following detailed description of the presently preferred exemplary embodiments, taken in conjunction with the accompanying drawings of which.

DETAILED DESCRIPTION OF THE PREFERRED EMBODIMENTS

An embodiment of a fixing device according to the invention will now be described with reference to FIGS. 1 and 2.

In the present invention, a device for fixing a toner image on a sheet of paper as an image forming medium in an image forming apparatus comprises a heating roller and a supporting roller for supporting the sheet of paper and transporting the paper, the heating roller having an inner peripheral surface, and at least one electrically resistive layer on the inner surface of the heating roller for fixing the toner image on the paper and reducing heat loss from the heating roller.

Figure 1:
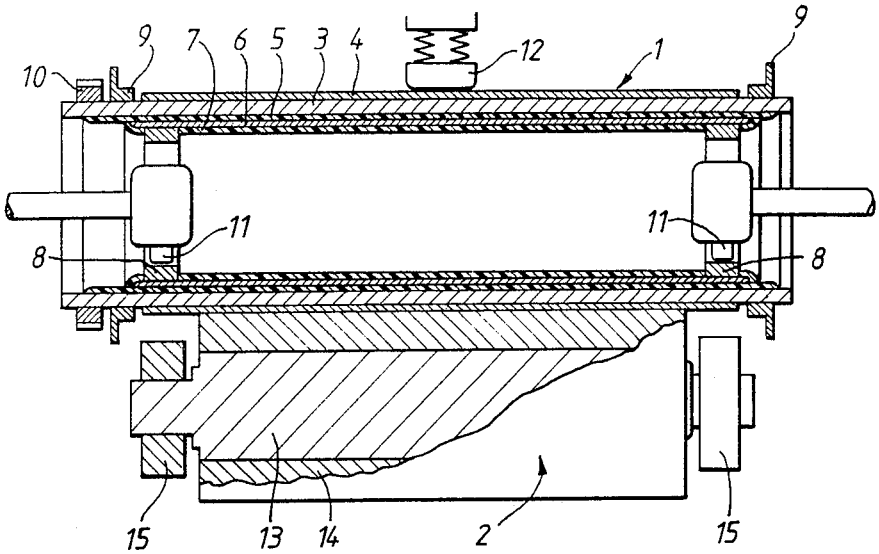
FIG. 1 is a sectional view showing a fixing device according to one embodiment of the present invention.
Figure 2:
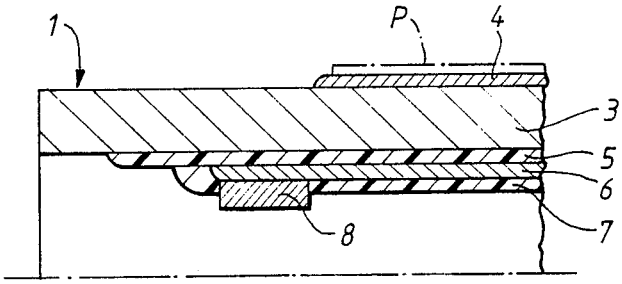
FIG. 2 is a fragmentary sectional view showing a part of a heating roller.

In FIG. 1, reference number 1 denotes a heating roller and 2 denotes a supporting roller that is in pressure contact with the heating roller 1. The heating roller 1 has a construction in which a parting layer 4 of fluororesin is formed on the outer peripheral surface of a cylindrical roller body 3 of metal or similar heat transmissive material.

On the inner peripheral surface side of the roller body 3, there is formed an electrically resistive heating layer 6. The electrically resistive heating layer 6 is covered by electrically insulating layers 5 and 7 for the sake of electrical safety.

In order to simplify the manufacturing process, the structure is one in which the electrically insulating layers 5 and 7 are provided separately above and below the electrically resistive heating layer 6. There are also provided ring-shaped electrodes 8 and 8 which contact axially opposite ends of the electrically resistive heating layer 6 and project beyond the outer surface of the electrically insulating layer 7.

The heating roller 1 is mounted in a frame (not shown) via heat insulating bearings 9 and it 9, has a heat insulating gear 10 mounted at one end thereof.

The structure is such that heating roller 1 is drivable by a drive system not shown which acts on the heat insulating gear 10. Power can be supplied, as required, to the electrically resistive heating layer 6 through contact of the ring-shaped electrodes 8 and 8 by power supply terminals 11 and 11 provided at opposite ends of the heating roller 1.

A temperature sensor 12 for detection of the surface temperature of the heating roller 1 is provided in sliding contact with the outer surface of the heating roller 1. The arrangement is such that action to supply power to the electrically resistive heating layer 6 is controlled by detection signals of the temperature sensor 12.

The thickness of the electrically insulating layer 5 preferably is the minimum allowable in terms of safety. For example, at a service rating of 240 V, the maximum allowable dielectric voltage is 1,000 V, the resistance is 2 MΩ and the layer thickness is 1 mm. At a service rating of 120 V, the maximum allowable dielectric voltage is 1,000 V, the resistance is 2 MΩ and the layer thickness is 0.8 mm.

In order to reduce the amplitude of temperature variations, the electrically resistive heating layer 6 and the roller body 3 are preferably made thicker, within a limit such that the rate of heat transmission is not overly reduced.

The supporting roller 2 has a core 13 whose outer peripheral surface is covered with an elastic layer 14 of silicon rubber, etc. The supporting roller 2 is pressed against the heating roller 1 by its bearings 15 and 15 being urged upwards by an urging means (not shown). A nip portion is defined at the location of rolling contact of the rollers 1 and 2.

A sheet of paper P as an image forming medium onto which a toner image has been formed is passed between the heating roller 1 and the supporting roller 2, which are in a heated and pressure contact state. As a result, the toner image is fixed on the sheet of paper P by application of heat and pressure.

The heat conduction efficiency in this process is improved, since the heating roller 1 has a structure in which the electrically resistive heating layer 6 is provided via the electrically insulating layer 5 on the inner peripheral surface of the roller body 3, and the roller body 3 is therefore heated directly. Consequently, power consumption is reduced, and heat transmission response is improved. Therefore the temperature variation amplitude and effect are reduced and fixing operations are stabilized. Further, since the portions to which power is supplied (i.e., the electrically resistive heating layer 6 and the ring-shaped electrodes 8 and 8) are located at the inner side of the roller body 3, there is good insulation with respect to external elements, which is of considerable advantage in terms of electrical safety.

Figure 3:
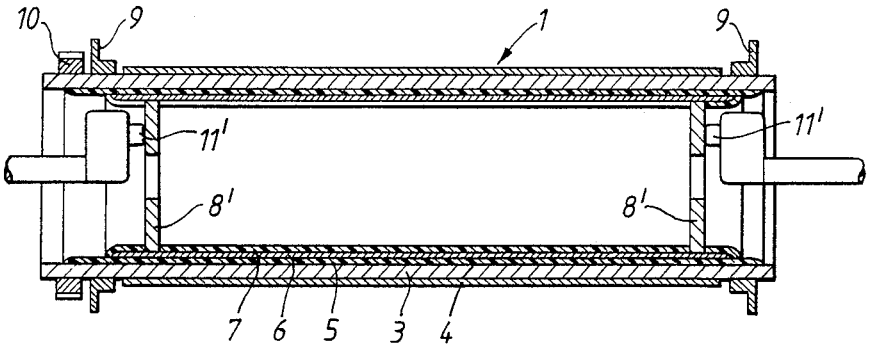
FIG. 3 is a sectional view showing a heating roller of a fixing device according to another embodiment of the present invention.

Although the structure in the above embodiment is one in which the power supply terminals 11 and 11 are pressed into contact with the inner peripheral surface of the ring-shaped power supply electrodes 8 and 8, the invention is not limited to this structure. For example, it is possible to have a structure in which, as shown in FIG. 3, plate-shaped power supply electrodes 8' and 8' and power terminals 11' and 11' are pressed into contact towards the end surfaces where these electrodes are provided.

It should be understood that the present invention may variously be changed and modified within the scope of the present invention.

In the above description of another embodiment (FIG. 3), parts which are the same as in the embodiment described earlier (FIGS. 1 and 2) are identified by the same reference numerals and detailed description thereof is omitted.

What is claimed is:

1. A device for fixing a toner image on an image forming medium in an image forming apparatus, said device comprising:

(a) a cylindrical roller body;

(b) a parting layer of fluororesin formed on the outer peripheral surface of said cylindrical roller body in surface abutting contact therewith;

(c) a first electrically insulating layer formed on the inner peripheral surface of said cylindrical roller body in surface abutting contact therewith;

(d) an electrically resistive heating layer formed on the inner peripheral surface of said first electrically insulating layer in surface abutting contact therewith;

(e) a second electrically insulating layer formed on the inner peripheral surface of said electrically resistive heating layer in surface abutting contact therewith, said second electrically insulating layer extending axially beyond said electrically resistive heating layer and, with said first electrically insulating layer, substantially encasing said electrically resistive heating layer;

(f) first and second ring-shaped electrodes in electrical contact with axially opposite ends of said electrically resistive heating layer and projecting radially inwardly through said second electrically insulating layer and beyond the inner peripheral surface of said second electrically insulating layer;

(g) first and second power supply terminals in sliding electrical contact with said first and second ring-shaped electrodes, respectively;

(h) first and second heat insulating bearings journalling the outer peripheral surface of said cylindrical roller body at axially opposite ends thereof;

(i) a heat insulating gear mounted on said cylindrical roller body for driving said cylindrical roller body in rotation;

(j) a supporting roller; and (k) means for urging said supporting roller toward said parting layer to define a nip therebetween.

2. A device as recited in claim 1 and further comprising a temperature sensor in sliding contact with the outer peripheral surface of said parting layer, said temperature sensor being operatively connected to said first and second power supply terminals so that the supply of power to said electrically resistive heating layer is controlled by said temperature sensor.

3. A device as recited in claim 1 wherein said first and second power supply terminals are in electrical contact with a radially inner surface of said first and second ring-shaped electrodes, respectively.

4. A device as recited in claim 1 wherein said first and second power supply terminals are in electrical contact with an axially outer surface of said first and second ring-shaped electrodes, respectively.

5. A device as recited in claim 1 wherein said heat insulating gear is mounted on the outer peripheral surface of said cylindrical roller body.

* * * * *